US008162522B2

(12) United States Patent
Hofmann

(10) Patent No.: US 8,162,522 B2
(45) **Date of Patent: *Apr. 24, 2012**

(54) LAMP

(75) Inventor: Harald Hofmann, Lüdenscheid (DE)

(73) Assignee: Osram AG, München (DE)

( * ) Notice: Subject to any disclaimer, the term of this patent is extended or adjusted under 35 U.S.C. 154(b) by 0 days.

This patent is subject to a terminal disclaimer.

(21) Appl. No.: 12/945,367

(22) Filed: Nov. 12, 2010

(65) Prior Publication Data

US 2011/0116270 A1 May 19, 2011

Related U.S. Application Data

(63) Continuation of application No. 10/591,929, filed on Sep. 5, 2006, now Pat. No. 7,857,496.

(51) Int. Cl.
*F21S 8/10* (2006.01)

(52) U.S. Cl. ..... 362/545; 362/391; 362/555; 362/296.1

(58) Field of Classification Search ..... 362/545, 362/550, 555, 350, 345, 391, 294, 296, 239, 362/247

See application file for complete search history.

(56) References Cited

U.S. PATENT DOCUMENTS

| | | | | |
|---|---|---|---|---|
| 2,025,819 | A | 12/1935 | Levy | |
| 5,782,553 | A | 7/1998 | McDermott | |
| 6,578,998 | B2 * | 6/2003 | Zhang | 362/555 |
| 2002/0136025 | A1 | 9/2002 | Zhang | |
| 2002/0158579 | A1 * | 10/2002 | Kai et al. | 313/635 |
| 2002/0191398 | A1 | 12/2002 | Keller | |
| 2003/0067784 | A1 | 4/2003 | Erber | |

FOREIGN PATENT DOCUMENTS

| | | | |
|---|---|---|---|
| CN | 1341233 | A | 3/2002 |
| DE | 19927142 | C1 | 12/2000 |
| EP | 1 357 335 | A | 10/2003 |
| FR | 2 831 647 | A | 5/2003 |
| JP | 11251637 | | 9/1999 |
| WO | WO 01/59359 | A | 8/2001 |

* cited by examiner

*Primary Examiner* — Julie Shallenberger
(74) *Attorney, Agent, or Firm* — Cozen O'Connor

(57) ABSTRACT

The invention relates to a lamp (10) comprising at least one base (11) which is joined to a light, comprising a dome-shaped, in particular dish-shaped, essentially rotationally symmetrical reflector (13), wherein a light source is arranged in the focal point (32) or focal point area thereof in order to produce an oriented, e.g. narrowly emitting, light distribution from said lamp (10). The reflector is provided with an opening (15) which comprises a light exit plane (E) for the lamp (10). The invention is characterized in that the light source is formed by at least one LED (20,20*a*,20*b*,20*c*) and is arranged at a distance from the inner side (14) of the reflector, and that a least one functional element of the LED, in particular at least one voltage supply line (21*a*,21*b*,21*c*,21*d*) of the LED and/or at least one cooling body (29,30*a*,30*b*,30*c*,30*d*) for the LED, extends at least partially essentially, along the light exit plane (E) or is arranged at least partially on the side of the light exit plane (E) which is oriented away from the reflector (13).

20 Claims, 3 Drawing Sheets

LAMP

CROSS REFERENCE TO RELATED APPLICATIONS

This application is a Continuation of U.S. patent application Ser. No. 10/591,929, filed Sep. 5, 2006 now U.S. Pat. No. 7,857,496, which claims priority from an application filed in Germany on Mar. 5, 2004, No. 10 2004 011 368.8 and a PCT Application filed on Mar. 3, 2005, No. PCT/DE2005/000369. The disclosure of all of these documents is incorporated herein by reference.

FIELD OF THE INVENTION

The invention relates to a lamp.

BACKGROUND OF THE INVENTION

Such a lamp is available under the trademark HALOSPOT from Osram GmbH in Munich. The known lamp, which is known for example under the designation HALOSPOT 111, has a plug-type base having two connection contact pins which is connected to a for example aluminum-coated reflector. In the region of the apex of the reflector, a halogen incandescent lamp is arranged as the light source, the incandescent filament being located approximately in the region of the focal point of the parabolic reflector. The halogen lamp is covered in the main emission direction of the lamp by a cap, which is held at the reflector edge by means of two grip webs. The cover cap prevents direct emission of light from the lamp in the main emission direction.

The known lamp has a defined, for example very small, emission angle, for example in the region of approximately 8°, and therefore allows for targeted illumination of building areas or objects in the form of accent lighting even over relatively long distances. The known lamp is typically used in the "shop illumination" sector.

SUMMARY OF THE INVENTION

On the basis of the known lamp, the object of the invention consists in providing a lamp having a relatively long life.

The invention achieves this object with the features that the light source is formed by at least one LED and is arranged spaced apart from the inside of the reflector, and that at least one functional element of the LED, in particular at least one voltage supply line of the LED and/or at least one heat sink for the LED, at least partially extends essentially along the light exit plane or at least partially is arranged on that side of the light exit plane which faces away from the reflector.

The principle of the invention therefore essentially consists in providing an LED in place of the known halogen incandescent lamp as the light source. As a result, the lamp can have a life which is extended by orders of magnitude. In this case, an LED module, for example an LED chip, may have one or more LEDs (light-emitting diodes.

The particular feature according to the invention of arranging the LED at a distance from the inside of the reflector allows for an essentially aperture-free design of the reflector. While, in the case of the lamp from the prior art, the incandescent lamp passes through the reflector approximately in the region of the apex of the reflector and is fixed to the reflector in the region of the apex, according to the invention it is possible to fix the LED at the edge region of the reflector by means of functional elements which extend essentially along a light exit plane of the lamp. At the same time, it is also possible according to the invention to allow power feed lines, i.e. voltage supply lines, to likewise extend in the region of the light exit plane of the lamp. Heat sinks, for example cooling blocks or cooling plates, can also be arranged on that side of the light exit plane which faces away from the reflector or on that side of the LED which faces away from the reflector.

Within the meaning of the invention, heat sinks for the LED, voltage supply lines for the LED, fixing elements for the LED which make it possible for the LED to be fixed in relation to the reflector and possibly also other parts of the LED unit, for example a chip body, are to be understood as being examples of functional elements.

Shadowing problems are avoided by the lamp according to the invention since the light emerging from the LED can impinge on the inside of the reflector without any obstacles and can be reflected and therefore passed on there in the desired manner. In the apex region of the reflector, no more components are arranged according to the invention which reduce the reflector area. Owing to the fact that the LED is arranged spaced apart from the apex region of the reflector, a component-free intermediate space is formed between the inner surface of the reflector and the actual light source.

Both the fixing elements for the LED and the cooling elements and voltage supply lines are arranged in the region of the reflector opening such that they make it possible for the entire luminous flux to pass through the reflector opening practically without any interference. The invention in this case recognizes that the arrangement of the functional elements for the LED in the region of the reflector opening results in markedly fewer shadowing problems than if the LED were to be connected directly to the apex region of the reflector.

Finally, the invention also allows for simple and efficient cooling of the LED unit, the heat sink(s) likewise being arranged at a distance from the apex of the reflector. It is thus possible, for example, for a heat sink in the form of a solid cooling block to be arranged on that side of the LED unit which faces away from the reflector and, owing to its compact and central arrangement, only to insignificantly influence the passage of light. To the same extent it is possible for heat sinks in the form of cooling plates to extend from the LED unit up to the edge of the reflector and, in the process, to have a cross-sectional area which projects onto the light exit plane, is negligibly small in relation to the total cross-sectional area of the reflector opening and therefore likewise only insignificantly impairs the exit of light from the lamp.

The principle according to the invention therefore consists in not arranging components of a geometrical size which is required in any case in a region of the apex of the reflector, where comparatively high light losses result, but arranging these components in a region of the reflector opening and, owing to a suitable geometrical design, keeping the proportion of the shadowing cross-sectional area of the components low in relation to the entire reflector opening.

The invention furthermore recognizes that an LED or an LED unit, i.e. an element which has one or more LEDs, only requires a very small amount of physical space and it is thus possible for it to be arranged in the focal point or in a focal point region of the reflector without more significant shadowing problems occurring.

The formulation in accordance with which the functional elements are arranged essentially along the light exit plane or on that side of the light exit plane which faces away from the reflector takes into account the fact that the functional elements are advantageously arranged at a point which is as far away from the apex region of the reflector as possible, i.e. also advantageously in the region of a free edge of the reflector.

The formulation is intended to include those exemplary embodiments in which the functional elements are arranged at a slight distance from the reflector opening. In particular, it is also possible in this context to envisage exemplary embodiments in which the actual, for example parabolic, reflector also has an associated free edge section, which has practically no additional light-deflecting or light-guiding function and therefore merely represents a type of extension of the reflector, for example for the purpose of fixing the reflector or for the purpose of limiting glare. In this case, the light exit plane within the meaning of the invention is at a slight distance from the actual reflector opening.

Directional light distribution is, for example, a narrowly emitting, i.e. predominantly parallel, emission which requires a parabolic reflector. As an alternative to this, directional emission is also understood to be focusing emission, however, which requires a, for example, elliptical reflector, i.e. a reflector whose reflector inner surface has the curved form of a section of an ellipse. The reflector is rotationally symmetrical in this case, too.

Furthermore, directional light distribution within the meaning of the invention is also to be understood as one which is achieved by virtually any desired surface structuring of the inner surface of the reflector, for example by means of applying a prism structure or the like. Such structures are known, for example, from the motor vehicle headlight sector and are referred to there as free polyhedra.

To the same extent, the inner surface of the reflector can also be segmented, with the result that different reflector contours are provided.

The lamp according to the invention has a base for connection to a luminaire-side lampholder. In this case, the base may be, for example, a base having a conventional design, as is known, for example, from the HALOSPOT 111, which forms an axial end region of the lamp. Alternatively, a luminaire-side fixing of the lamp can also take place, however, by fixing elements being arranged in the region of the reflector edge which interact with luminaire-side fixing elements. In this case, a mounting ring or the like also comes into consideration as the fixing element. In such an embodiment, the lamp-side fixing region which interacts with the fixing element is understood within the meaning of the invention to be the base of the lamp.

The base of the lamp according to the invention may also have the electrical connection contacts for connection to luminaire-side mating connection contacts, for example in the form of connection contact pins, which are arranged within the base, as is the case with the known HALOSPOT 111. As an alternative, the lamp can also have associated connection lugs or connection contacts, which are electrically connected to the LED unit and allow for an in particular direct, luminaire-side screw or clamping connection. The mechanical fixing in this case takes place only subsequently, for example once a mounting ring has been inserted.

In accordance with one advantageous refinement of the invention, the functional element protrudes at least partially out of the reflector opening. This design of the functional element takes into account the fact that shadowing problems are kept low if the cross section of the functional element which projects onto the light exit plane only makes up a small proportion of the area of the total reflector opening, whereas an extension of the functional element out of the reflector opening, i.e. starting from the light exit plane, directed away from the reflector element essentially in the central longitudinal axis of the reflector, does not involve any more significant shadowing problems.

In accordance with one further advantageous refinement of the invention, the LED has at least one associated voltage supply line, which extends essentially along the light exit plane. The arrangement of at least one voltage supply line takes place such that the electrical connection between the LED and the connection contacts arranged on the base does not take place on the shortest path along the longitudinal center axis of the lamp, but is established by means of a type of detour, which comprises, for example, engaging around the reflector edge at least one point and guiding the voltage supply line along on the outside of the reflector. In practice, this allows for an aperture-free reflector surface. In particular in the apex region of the reflector, apertures for providing voltage supply lines are no longer required.

If only two voltage supply lines are required for supplying the voltage, these voltage supply lines can preferably extend in the opposite direction to one another, i.e. diametrically, essentially in the region of the light exit plane. This also provides advantages as regards stability when fixing a unit which has functional elements of the LED to the reflector, which fixing will be described later. If the LED unit has three voltage supply lines which are required, for example, for being able to drive two different LEDs or two different types of LEDs, for example LEDs of different colors, separately, these voltage supply lines are preferably arranged at a respective circumferential angle of 120° with respect to one another along the light exit plane.

If four voltage supply lines are required, for example in order to be able to drive at least three different LEDs or three different types of LEDs, for example a red LED, a green LED and a blue LED, individually, these four voltage supply lines are advantageously arranged such that in each case two voltage supply lines essentially enclose an angle of 90° along the light exit plane with respect to one another.

In accordance with one advantageous refinement of the invention, at least one voltage supply line is provided which engages around one edge of the reflector opening. This refinement of the invention allows for a design of a lamp which on the one hand results in virtually no shadowing problems and, on the other hand, ensures a safe and stable electrical connection between the LED and the lamp base and also offers advantages as regards simple installation.

In accordance with one further advantageous refinement of the invention, a transparent cover element is associated with the reflector and closes the reflector opening. This cover element means that cleaning measures are no longer necessary over a long life of the lamp. Apart from a receptacle for the LED unit, which is arranged approximately in the center of the cover element, i.e. in the region of the longitudinal center axis of the reflector, this cover element completely closes the reflector opening and prevents the ingress of dust or dirt particles into the reflector interior. The reflector interior is thus sealed and allows for maintenance-free lamp operation.

In accordance with one further advantageous refinement of the invention, at least one voltage supply line is provided which is arranged on that side of the cover element which faces away from the reflector. In accordance with this refinement of the invention, the cover element therefore possibly also has the function of a carrier element for the voltage supply line and allows for particularly simple attachment or fixing of the voltage supply line to the reflector. For this purpose, the cover element can be connected, for example adhesively bonded, for example directly to the free edge of the reflector. Alternatively, the voltage supply line, which can also be an integral part of a unit comprising further functional elements, can be fixed to the cover element or directly to the reflector. That side of the cover element which faces away from the reflector can therefore provide a bearing surface for a unit and therefore ensure simple positioning during installation at the manufacturing stage.

In accordance with one further advantageous refinement of the invention, a grip part is provided on that side of the light exit plane or, if provided, on that side of the cover element which faces away from the reflector. This grip part may be, for example, part of a module having functional elements, which module comprises, for example, heat sinks and voltage supply lines and insulating layers or insulating bodies which may be required. The grip part can, on the one hand, allow for particularly simple installation of this module on the reflector. On the other hand, the grip part may advantageously also be used for inserting the lamp into a provided lampholder if only very small installation areas are available for the lamp.

In accordance with one further advantageous refinement of the invention, the LED has at least one associated heat sink for heat dissipation purposes. This refinement of the invention provides the advantage of a long life for the lamp.

In accordance with one further advantageous refinement of the invention, the heat sink is spaced apart from the apex of the reflector. This arrangement of the heat sink makes it possible to pass on light emitted by the LED or the LED unit, virtually unimpaired, within the reflector interior.

In accordance with one further advantageous refinement of the invention, the heat sink is arranged on that side of the light exit plane and/or the LED which faces away from the reflector. This refinement of the invention envisages positioning the heat sink as far away from the apex of the reflector as possible and therefore further contributes to essentially interference-free light guidance within the reflector.

In accordance with one further advantageous refinement of the invention, the heat sink is formed by a compact, in particular solid cooling block. In this refinement of the invention, it is possible for the required physical space for accommodating the heat sink to be kept small. This makes it possible to arrange the cooling block essentially in the region of a longitudinal center axis of the reflector, preferably on that side of the light exit plane which faces away from the reflector and/or on that side of the LED which faces away from the reflector. This further reduces shadowing problems and assists with the advantageous convection of heat.

In accordance with one further advantageous refinement of the invention, the heat sink comprises a cooling plate, which extends essentially along the light exit plane. In this refinement of the invention, a larger surface area is achieved in comparison with a cooling block, which facilitates the convection of heat. At the same time, it is possible to achieve a stable arrangement of the heat sink, the LED unit, the voltage supply lines and the reflector whilst maintaining essentially interference-free light deflection within the reflector. The cooling plates can provide, for example, the abovementioned grip parts. Furthermore, they may be part of a module, which fixes the LED unit to the reflector. It is thus possible, for example, for the cooling plate to extend from the LED, i.e. the center point of the reflector opening, essentially up to one edge of the reflector opening and in this manner to ensure a stable connection, for example by engaging around the edge or by possibly interacting with a fixing element, for example with a clamping ring or mounting ring, which ensures that the preassembled module is fixed indirectly on the reflector.

In accordance with one further advantageous refinement of the invention, the reflector is essentially continuous. Such a continuous design of the reflector is provided in particular in the region of its apex. This allows for unimpaired guidance of light within the reflector interior. In addition, the reflector of the lamp and therefore also the entire lamp can now be produced and installed in a more simple manner.

The invention may generally comprise a lamp, comprising at least one base for connection to a luminaire, having a curved, essentially rotationally symmetrical reflector; a light source arranged in the focal point or focal point region of said reflector for the purpose of producing a directional light distribution of the lamp, the reflector having a reflector opening which provides a light exit plane of the lamp, wherein the light source is formed by at least one LED and is arranged spaced apart from the inside of the reflector, and wherein at least one functional element of the LED, at least partially extends essentially along the light exit plane or is arranged at least partially on that side of the light exit plane which faces away from the reflector.

It is an advantageous refinement that the functional element protrudes at least partially out of the reflector opening.

It is another advantageous refinement that the LED has at least one associated voltage supply line, which extends essentially along the light exit plane.

It is yet another advantageous refinement that two voltage supply lines are provided for the LED which extend essentially diametrically with respect to one another.

It is even another advantageous refinement that three voltage supply lines for the LED are provided, of which in each case two enclose an angle of approximately 120° along the light exit plane.

It is still another advantageous refinement that four voltage supply lines for the LED are provided, of which in each case two enclose an angle of approximately 90° along the light exit plane.

It is another advantageous refinement that at least one voltage supply line is provided which engages around one edge of the reflector opening.

It is yet another advantageous refinement that a transparent cover element is associated with the reflector and closes the reflector opening.

It is even another advantageous refinement that the cover element is essentially in the form of a circular disk.

It is still another advantageous refinement that the cover element has a central opening for accommodating the LED.

It is another advantageous refinement that at least one voltage supply line is provided which is arranged on that side of the cover element which faces away from the reflector.

It is still another advantageous refinement that a grip part is provided on that side of the light exit plane which faces away from the reflector.

It is yet another advantageous refinement that the LED has at least one associated heat sink for heat dissipation purposes.

It is another advantageous refinement that the heat sink is spaced apart from the apex of the reflector.

It is another advantageous refinement that the heat sink is arranged on that side of light exit plane and/or LED which faces away from the reflector.

It is even another advantageous refinement that the heat sink has a compact, in particular solid cooling block.

It is yet another advantageous refinement that the cooling block is arranged essentially in the region of a longitudinal center axis of the reflector.

It is still another advantageous refinement that the heat sink comprises a cooling plate, which extends essentially along the light exit plane.

It is another advantageous refinement that the cooling plate extends from the LED essentially up to one edge of the reflector opening.

It is another advantageous refinement that the reflector is essentially continuous.

It is yet another advantageous refinement that the reflector is free of apertures in the region of its apex.

It is still another advantageous refinement that the reflector is parabolic.

It is even another advantageous refinement that the light source produces a narrowly emitting light distribution.

It is another advantageous refinement that the functional element of the LED which at least partially extends essentially along the light exit plane or is arranged at least partially on that side of the light exit plane which faces away from the reflector is at least one voltage supply line of the LED and/or at least one heat sink for the LED.

It is another advantageous refinement that the three voltage supply lines are for an LED unit having at least two LEDs.

It is even another advantageous refinement that the four voltage supply lines are for an LED unit having at least three LEDs.

It is another advantageous refinement that the at least one base for connection to the luminaire has a curved, essentially rotationally symmetrical reflector with a continuous shell shape.

It is yet another advantageous refinement that an edge of said continuous shell shape of said reflector defines a reflector opening which provides a light exit plane of the lamp, wherein the light source is formed by at least one LED and is arranged spaced apart from the inside of the reflector

BRIEF DESCRIPTION OF THE DRAWINGS

Further advantages of the invention are given with reference to the now following description of an exemplary embodiment illustrated in the Figures, in which.

DETAILED DESCRIPTION OF THE DRAWINGS

The lamp, which is denoted overall by 10 in its entirety in the Figures will be explained in more detail below. In this case, reference will now already be made to the fact that identical or comparable parts or elements have been denoted by the same reference symbols, sometimes with lower-case letters added on, for reasons of clarity.

Figure 1:
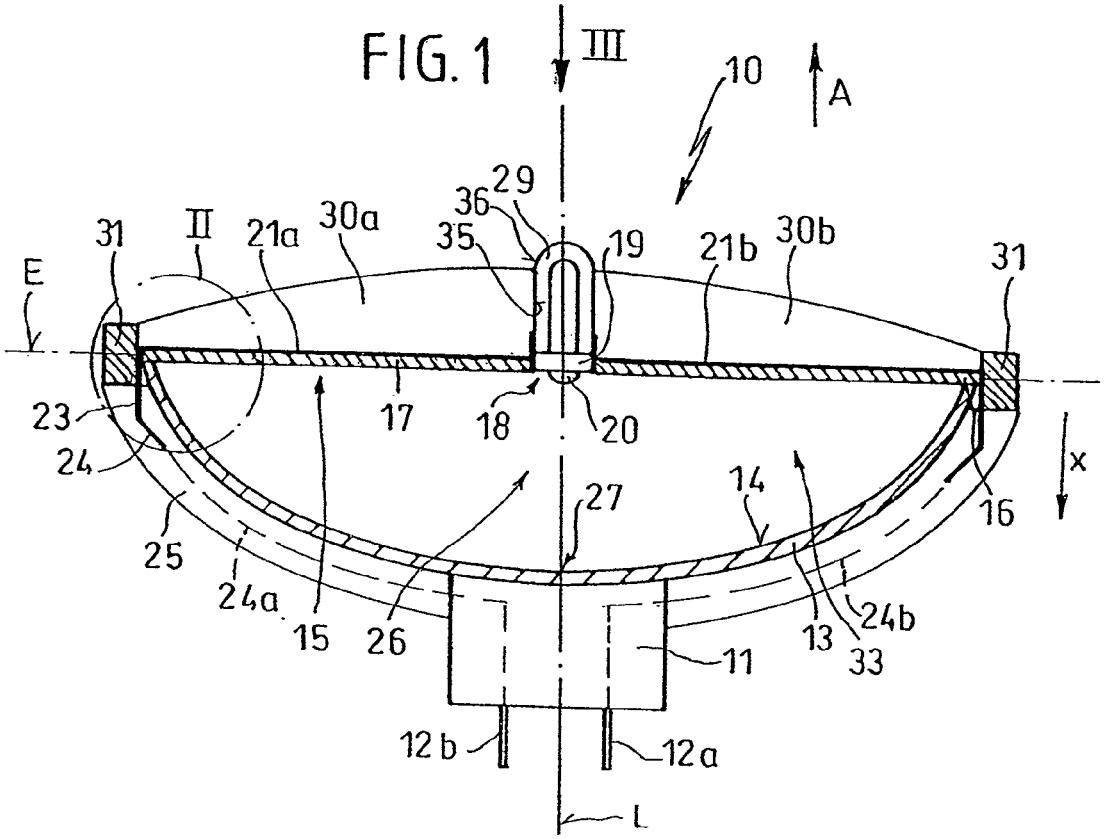
FIG. 1 shows a schematic, partially sectioned view of a lamp according to the invention.

With reference to FIG. 1, it is clear that a first exemplary embodiment of the lamp 10 has a base 11, in which two contact pins 12*a*, 12*b* are fixed. The number of contact pins is in this case initially to be understood as being exemplary and depends on the type of LEDs used and the number of LEDs, in particular the manner in which the LEDs are intended to be driven. For this purpose, an electronic control device (not illustrated) in the form of a ballast can also be arranged on the lamp 10. Such a ballast is preferably arranged on the luminaire side, however, i.e., in terms of flow, on that side of the lampholder (not illustrated) which faces away from the lamp 10. Finally, the type of contact pins to be used also depends on the required supply voltage.

The base 11 is connected to a reflector 13, which, in accordance with the exemplary embodiment, is essentially parabolic and has a continuous shell shape. The reflector is designed to be rotationally symmetrical about the longitudinal center axis L of the lamp 10 and has a focal point or focal point region 32 which is arranged in the region of the longitudinal center axis L and is spaced apart from an apex or apex region 27 of the reflector 13. The reflector interior 33 (FIG. 4) is essentially empty.

The reflector 13 comprises a reflector opening 15, which is bordered by an edge 16 of the reflector. The edge 16 is connected to a clamping or mounting ring 31. The reflector opening 15 provides a light exit plane E.

An LED unit 19 having at least one LED 20, 20*a*, 20*b*, 20*c* is arranged in the region of the focal point 32 of the reflector 13. The LED 20, 20*a*, 20*b*, 20*c* emits light essentially in the x direction, which light impinges on the, for example, mirror-coated, but in any case reflective inner surface 14 of the reflector 13. The light is deflected by the reflector such that the light emitted by the LED(s) 20, 20*a*, 20*b*, 20*c*, 20*d*, 20*e* leaves the lamp 10 essentially in the main emission direction A and represents an essentially parallel focused beam with only very low beam expansion of a few degrees.

Figure 2:
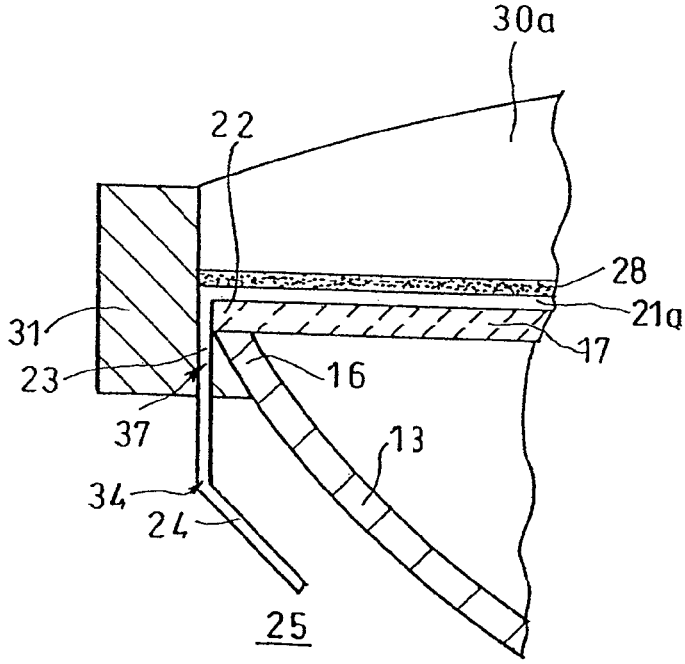
FIG. 2 shows a second exemplary embodiment of a lamp according to the invention in an illustration in accordance with an enlarged detail, for example in accordance with the detail circle II in FIG. 1.
Figure 4:
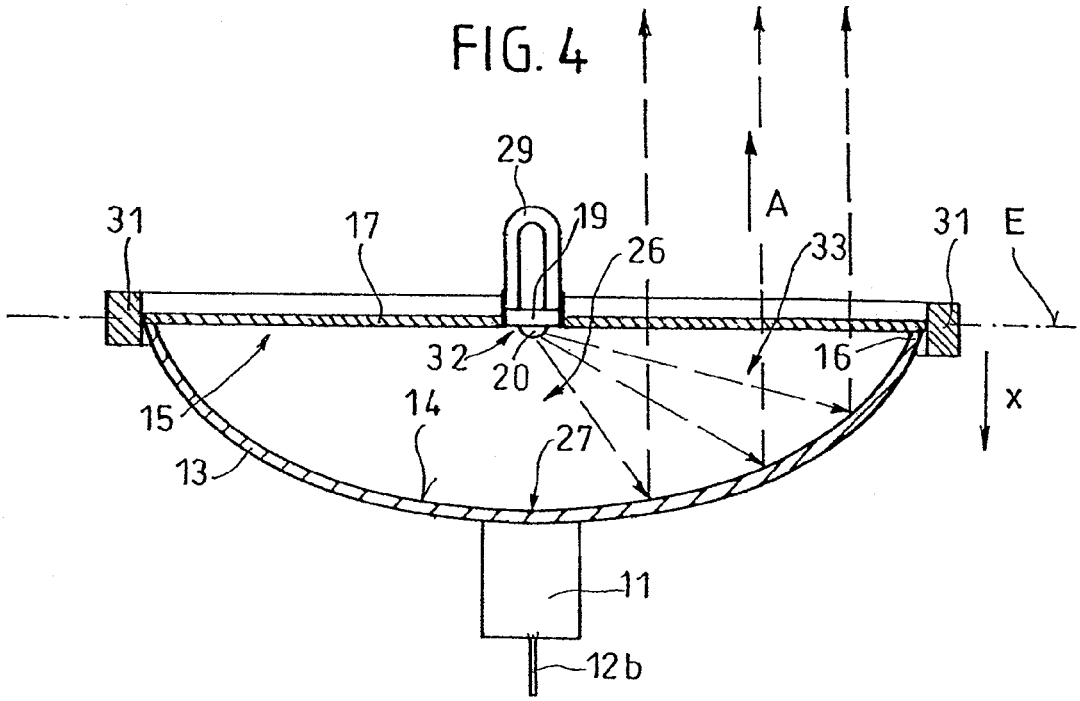
FIG. 4 shows the lamp shown in FIG. 1 in a position which has been rotated through 90° about the central longitudinal axis (cf. in this regard also the section-line indications I-I in FIG. 3 and IV-IV in FIG. 3)

As can be seen in particular from FIGS. 1, 2 and 4, a cover element 17, which is essentially in the form of a circular disk, has a central cutout 18 for accommodating the LED unit 19 and is connected with its outer edge region 22 to the free edge region 16 of the reflector element 13, is also provided. The reflector interior 33 is virtually completely sealed off by the cover element 17. The cover element 17 consists of a transparent material, for example a transparent plastic, such as acrylic glass and has a smooth or structured surface.

The LED unit 19 is, for example, an LED chip, i.e. a carrier module, which has at least one LED and has the necessary electrical connection contacts for the LED(s). In order to supply an operating voltage to the at least one LED 20, at least two voltage supply lines 21*a*, 21*b* are required. In accordance with the exemplary embodiment, these voltage supply lines are guided essentially along the light exit plane E from the LED unit 19 towards the edge 16 of the reflector 13. The voltage supply lines 21*a*, 21*b* rest directly on the cover element 17.

In one embodiment (not illustrated), the voltage supply lines may also possibly be an integral part of a cover element 17.

As can be seen in particular from FIGS. 1 and 2, the voltage supply line 21*a* (and equally the opposite voltage supply line 21*b* in a manner which is not illustrated) engages around the edge region 22 of the cover element 17 and the edge region 16 of the reflector 13 and in the process merges with a connection lug 23. In order to connect the connection lug 23 to the contact pins 12*a*, 12*b* in the base 11, a rearward section of the voltage supply line 24 (or 24*a*, 24*b*) is provided. The rearward section 24, 24*a*, 24*b* of the voltage supply line extends on that side of the reflector 13 which faces away from the LED unit 19 and is merely illustrated schematically in FIG. 1. An enveloping body 21, which provides, for example, plastic embedding for the line section 24, or else an insulating coating can ensure that the voltage supply line sections 24, 24*a*, 24*b* are not freely accessible.

In one second exemplary embodiment of the invention, which is indicated schematically in FIG. 2, the base 11 (illustrated in FIG. 1) of the lamp can be dispensed with. The rearward voltage supply line sections 24*a*, 24*b* illustrated in FIG. 1 are in this case likewise not necessary. Instead, the lamp is fixed by means of a clamping or mounting ring 31 directly on the luminaire side at a fixing point (not illustrated) provided for this purpose. The bent-back connection lug, denoted by 24 in FIG. 2, may be in the form of a plug-in contact or in the form of a screw contact and can interact directly with luminaire-side mating connection lines or mating connection contacts. In this case, it would initially be conventional to ensure that electrical contact is made when fitting the lamp, for example by carrying out the screw-fixing and then fixing the lamp 10 on the luminaire side by means of the clamping or mounting ring 31.

In this case, the clamping or mounting ring 31 of the lamp 10 is designated as the base within the meaning of the invention.

Of particular importance in all exemplary embodiments is the fact that the voltage supply lines 21*a*, 21*b* extend in the region of the light exit plane E and in this manner only take up a small proportion of the area of the reflector opening 15, and otherwise do not impair the light guidance within the reflector interior 33.

The beam extent of the light emitted by the LED is indicated by dashed arrows schematically in FIG. 4.

One further feature consists in the fact that the LED unit 19 may have associated cooling elements in the form of a cooling block 29 or in the form of cooling plates 30*a*, 30*b*, 30*c*, 30*d*, which are arranged on that side of the LED unit 19 which faces away from the reflector 13 and/or on that side of the light exit plane E which faces away from the reflector. As shown in FIGS. 1 and 2, a cooling block 29 is provided which is essentially in the form of a bulb and extends away from the actual LED chip 19 in the main emission direction A, i.e. essentially along the longitudinal center axis L of the lamp 10. The area of the LED chip 19 and the cooling block 29 which can be projected onto the light exit plane E can therefore be kept relatively small. While, in the case of LED chips from the prior art, as are made available at present by LED chip manufacturers, the LED chips are extended to a very great extent in one plane since the cooling faces are arranged along the plane along which the chip extends, it is possible according to the invention to accommodate a cooling block 29 without significantly impairing the light exit owing to the more compact design of the LED chip. The specific refinement of the LED chip can in this case be as desired. In this case, it is possible to draw on experiences when connecting cooling faces to the LED in the case of conventional LED chip arrangements. For example, the cooling block 29 can dissipate the heat produced during operation of the LED away from the rear of an LED chip 19. Other connections are likewise conceivable.

Merely as a supplementary comment, mention will be made of the fact that an LED chip unit, which has been brought onto the market under the designation "Lumiled", can particularly advantageously be used as the LED unit 19, in the case of which the heat produced by the LEDs during operation can be passed on in a particularly simple manner from a chip body arranged on the chip to a cooling element.

Furthermore, FIG. 1 also shows the arrangement of two cooling plates 30*a*, 30*b*, which extend in the manner of webs from the LED chip 19 towards the edge 16 of the reflector element 13. In this context, mention will be made of the fact that the exemplary embodiment illustrated in the Figures provides both cooling plates 30*a*, 30*b* and a cooling block 29. This is to be understood as being merely by way of example. Alternatively, lamps can also be provided which have only one cooling block or only one or more cooling plates.

In accordance with the exemplary embodiment, the cooling plate 30*a* makes contact, with its central contact face 35, with the outer side 36 of the cooling block 29 and forms a thermal bridge for heat guidance purposes. This is also merely to be understood as an example since other contact-making possibilities between the cooling plates 30*a*, 30*b* and the LED chip 19 are also possible.

However, the cooling plates 30*a*, 30*b*, 30*c*, 30*d* make it possible to provide a large surface area such that particularly effective cooling and convection of the heat produced to the surrounding environment is achieved.

The cooling plates 30*a*, 30*b* are arranged, with respect to the emission direction A of the lamp 10, so as to be aligned with the voltage supply lines 21*a*, 21*b*, 21*c*, 21*d*. This can also be seen from FIGS. 5 to 7, which will be explained in more detail later. In this case, it is advantageous that the cross section assumed overall by the cooling plates and the voltage supply lines, i.e. their area projected onto the light exit plane, only assumes a very small proportion of the area provided overall by the reflector opening 15.

As can clearly be seen in particular in FIG. 2, an insulating layer 28 or an insulating body is arranged between the voltage supply line 21*a* and the corresponding cooling plate 30*a*. This ensures electrical isolation of these two components.

In one embodiment (not illustrated), it is possible for the cooling plates 30*a*, 30*b*, 30*c*, 30*d* and the corresponding voltage supply line 21*a*, 21*b*, 21*c*, 21*d* to be electrically connected to one another. The insulating body 28 can be dispensed with in such an embodiment. In the case of the embodiment described here and illustrated in the drawings, the electrical isolation between the cooling plates 30*a*, 30*b*, 30*c*, 30*d* and the voltage supply lines 21, 21*b*, 21*c*, 21*d* is desirable, however.

Furthermore, as can be seen from FIG. 2, a fixing element 31, which in the exemplary embodiment is in the form of a clamping or mounting ring, is provided in order to make it possible to fix the LED unit 19, the cooling elements 29, 30*a*, 30*b*, 30*c*, 30*d*, the insulating body 28 and the voltage supply lines 21*a*, 21*b*, 21*c*, 21*d* with the reflector 13 on a luminaire. In this context, reference is made to the fact that some or all of the following elements LED unit 19, cooling block 29, cooling plates 30*a*, 30*b*, 30*c*, 30*d*, voltage supply lines 21*a*, 21*b*, 21*c*, 21*d* and insulating body 28 can form a common, preassembled unit. In addition, mention will be made of the fact that the clamping or mounting ring 31 can also be connected, preassembled, to this module and, as the base, can provide the connection to the luminaire instead of the base 11.

Figure 3:
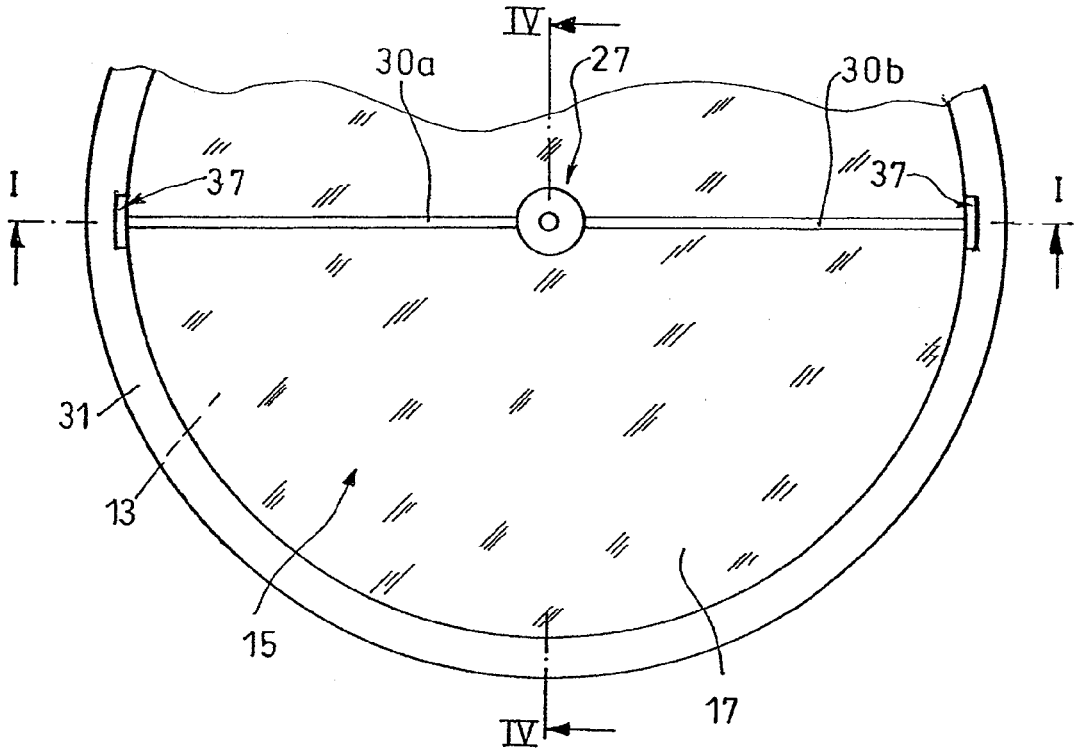
FIG. 3 shows the lamp shown in FIG. 1 in a plan view in accordance with the viewing arrow III in FIG. 1.

In the exemplary embodiment, all of the previously listed components are connected to form a manageable module. Cutouts 37 (see in particular FIG. 3) for the connection lugs 23 can also be provided on the clamping ring 31.

In addition, mention will be made of the fact that, in the exemplary embodiment, the cooling plates 30*a*, 30*b*, 30*c*, 30*d* directly provide a grip body. In the ready-installed state, the entire lamp 10 can be grasped by gripping the cooling plates and can be installed in a simple manner.

Figure 5:
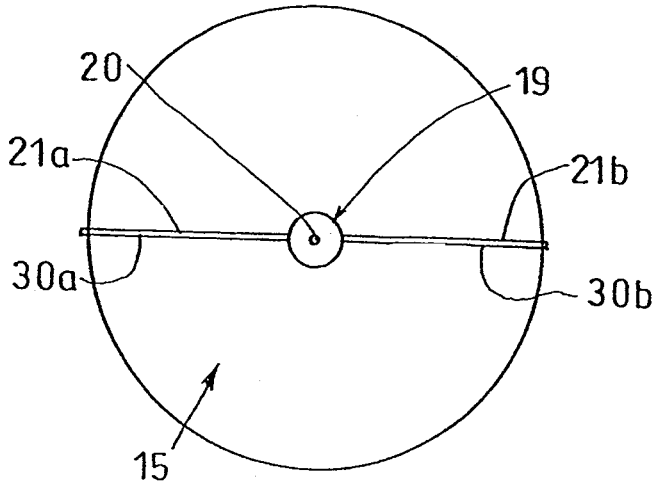
FIG. 5 shows the exemplary embodiment of FIGS. 1 to 4 in a schematic illustration, approximately in accordance with FIG. 3.
Figure 7:
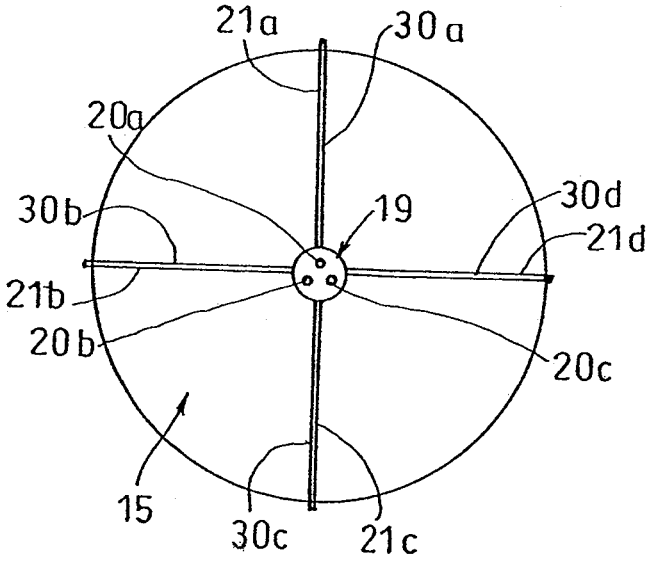
FIG. 7 shows a fourth exemplary embodiment of the lamp according to the invention in an illustration as shown in FIG. 5.

In this case, as can be seen in particular from FIGS. 5 and 7 and FIG. 1, the cooling plates are designed to be relatively narrow, but have a relatively high height extending in the emission direction A. This geometrical design makes it easier to grasp the cooling plates, but does not impair the light emission, on the other hand.

Figure 6:
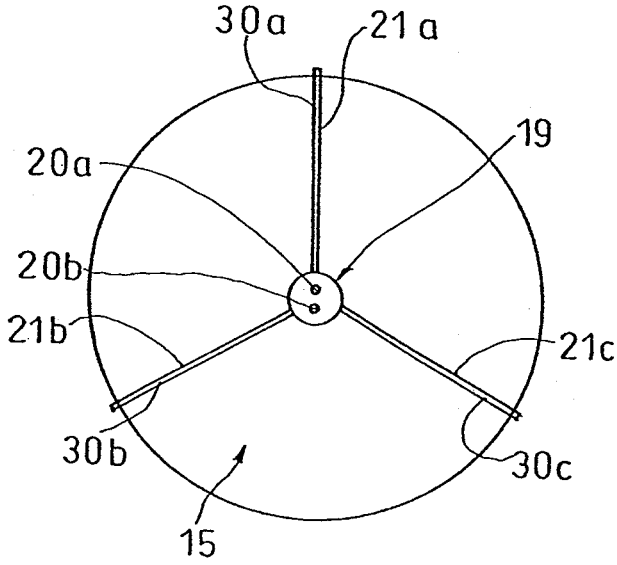
FIG. 6 shows a third exemplary embodiment of the lamp according to the invention in an illustration as shown in FIG. 5.

FIGS. 5 to 7 show, in a plan view of the reflector opening 15, various geometrical arrangements and embodiments of lamps depending on the number of voltage supply lines required. If, as is indicated in FIG. 5, only one LED or only one type or group of a plurality of LEDs is provided, only two voltage supply lines 21*a*, 21*b* are required, which extend opposite, i.e. essentially diametrically, with respect to one another. FIG. 6 shows an arrangement with two LEDs or groups of LEDs which can be driven differently, as a consequence of which at least three voltage supply lines are required owing to requirements in terms of circuitry in order to be able to drive these two LEDs individually. Accordingly, an arrangement advantageously results in which in each case two voltage supply lines enclose a circumferential angle of 120° with one another along the light exit plane E.

FIG. 7 shows a third exemplary embodiment, in which three LEDs (for example red, green, blue) or three groups of LEDs, which can be driven individually, are provided.

Accordingly, four voltage supply lines are arranged which enclose an angle of 90° between them.

As has previously been mentioned, the exemplary embodiments in FIGS. 5 to 7 also have heat-dissipating cooling plates 30*a*, 30*b*, 30*c*; 30*d*, which are arranged in an aligned arrangement with respect to the voltage supply lines 21*a*, 21*b*, 21*c*, 21*d*. This results in an area (in the case of projection onto the light exit plane E) which is projected by the voltage supply lines or the cooling plates 30*a*, 30*b*, 30*c*, 30*d* and only has a very low proportion in relation to the entire reflector opening lying in the light exit plane E. Light can therefore be emitted practically without interference.

The invention claimed is:

1. A lamp, comprising:

at least one base for connection to a luminaire, having a curved, essentially rotationally symmetrical reflector with a continuous shell shape;

a light source arranged in the focal point or focal point region of said reflector for the purpose of producing a directional light distribution of the lamp, an edge of the continuous shell shape of the reflector defining a reflector opening which provides a light exit plane of the lamp, wherein the light source is formed by at least one LED and is arranged spaced apart from the inside of the reflector, and wherein at least one functional element of the LED, at least partially extends essentially along the light exit plane or is arranged at least partially on that side of the light exit plane which faces away from the reflector, and a transparent cover element associated with the reflector and closing the reflector opening, wherein the at least one functional element is at least one voltage supply line that contacts the cover element and engages and extends around an edge of the cover element and the edge of the continuous shell shape of the curved, essentially rotationally symmetrical reflector outside of the reflector opening, and wherein the cover element has a central opening for accommodating the LED therein.

2. The lamp as claimed in claim 1, wherein the functional element protrudes at least partially out of the reflector opening.

3. The lamp as claimed in claim 1, wherein the at least one voltage supply line is provided for the LED and extends essentially along the light exit plane.

4. The lamp as claimed in claim 3, wherein the at least one functional element includes two voltage supply lines provided for the LED which extend essentially diametrically with respect to one another.

5. The lamp as claimed in claim 3, wherein the at least one functional element includes three voltage supply lines for the LED, of which in each case two enclose an angle of approximately 120° along the light exit plane.

6. The lamp as claimed in claim 3, wherein the at least one functional element includes four voltage supply lines for the LED, of which in each case two enclose an angle of approximately 90° along the light exit plane.

7. The lamp as claimed in claim 1, wherein at least one voltage supply line engages at the edge of the reflector opening.

8. The lamp as claimed in claim 1, wherein the cover element is essentially in the form of a circular disk.

9. The lamp as claimed in claim 1, wherein the at least one voltage supply line is arranged on that side of the cover element which faces away from the reflector.

10. The lamp as claimed in claim 1, wherein a grip part is provided on that side of the light exit plane which faces away from the reflector.

11. The lamp as claimed in claim 1, wherein the LED has at least one associated heat sink for heat dissipation purposes.

12. The lamp as claimed in claim 11, wherein the heat sink is spaced apart from the apex of the reflector.

13. The lamp as claimed in claim 11, wherein the heat sink is arranged on that side of light exit plane and/or LED which faces away from the reflector.

14. The lamp as claimed in claim 11, wherein the heat sink has a compact, in particular solid cooling block.

15. The lamp as claimed in claim 14, wherein the cooling block is arranged essentially in the region of a longitudinal center axis of the reflector.

16. The lamp as claimed in claim 11, wherein the heat sink comprises a cooling plate, which extends essentially along the light exit plane.

17. The lamp as claimed in claim 1, wherein the reflector is essentially continuous.

18. The lamp as claimed in claim 1, wherein the functional element of the LED which at least partially extends essentially along the light exit plane or is arranged at least partially on that side of the light exit plane which faces away from the reflector is at least one voltage supply line of the LED and/or at least one heat sink for the LED.

19. The lamp as claimed in claim 5, wherein the three voltage supply lines are for an LED unit having at least two LEDs.

20. The lamp as claimed in claim 6, wherein the four voltage supply lines are for an LED unit having at least three LEDs.

* * * * *